US007066769B2

(12) United States Patent
Zhu et al.

(10) Patent No.: US 7,066,769 B2
(45) Date of Patent: Jun. 27, 2006

(54) ELECTRICAL CONNECTOR

(75) Inventors: ZiQiang Zhu, Kunsan (CN); Guohua Zhang, Kunsan (CN); Wenke He, Kunsan (CN); Yulong Mao, Kunsan (CN); Bo Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,550

(22) Filed: Dec. 28, 2004

(65) Prior Publication Data

US 2005/0176306 A1 Aug. 11, 2005

(30) Foreign Application Priority Data

Feb. 11, 2004 (CN) ..... 2004 2 0024679 U

(51) Int. Cl.
*H01R 33/00* (2006.01)

(52) U.S. Cl. ..... 439/660

(58) Field of Classification Search ..... 439/607, 439/108, 610, 79, 101, 660
See application file for complete search history.

(56) References Cited

U.S. PATENT DOCUMENTS 5,993,258 A 11/1999 Matsunuma et al.

*Primary Examiner*—Briggitte R. Hammond
(74) *Attorney, Agent, or Firm*—Wei Te Chung

(57) ABSTRACT

An electrical connector (1) includes an insulative housing (10), a plurality of conductive contacts (20) being received in the insulative housing and a metal shield (30) enclosing the housing. The insulative housing includes a base portion (11) and a tongue portion (12) forwardly extending from the base portion. The tongue portion defines a plurality of channels (13) in a bottom surface thereof. The base portion defines a pair of notches (14) adjacent to the channels. The conductive contacts includes four first conductive contacts (21) being received in the channels and dual second conductive contacts (22) being received in the notches.

12 Claims, 6 Drawing Sheets

ELECTRICAL CONNECTOR

BACKGROUND OF THE INVENTION

1. Field of the Invention

The present invention generally relates to an electrical connector, and more particularly to an electrical connector which has improved data transmission speed.

2. Description of the Prior Art

I/O connectors, such as Digital Visual Interface (DVI), Deutsche Institute Normen (DIN) and Universal Serial Bus (USB) are widely used in computer appliances. With the development of technology, it is an increased need to improve the transmission speed of the computer. U.S. Pat. No. 5,993,258 issued on Nov. 30, 1999 discloses a USB connector comprising an insulative housing, a metal shield enclosing the insulative housing. The housing includes a base portion and a tongue portion forwardly extending from the base portion. The tongue portion defines four channels for receiving four conductive contacts. However, the conventional USB connector can not meet the demand of higher transmission speed.

Hence, an improved electrical connector is directed to overcome the above problem.

SUMMARY OF THE INVENTION

It is an object of the present invention to provide an electrical connector which can improve the transmission speed.

In order to attain the object above, an electrical connector in accordance with the present invention includes an insulative housing, a plurality of conductive contacts being received in the insulative housing and a metal shield enclosing the housing. The insulative housing includes a base portion and a tongue portion forwardly extending from the base portion. The tongue portion defines a plurality of channels in a bottom surface thereof. The base portion defines a pair of notches adjacent to the channels. The conductive contacts include four first conductive contacts being received in the channels and dual second conductive contacts being received in the notches.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIEMNT

Reference will now be made in detail to the preferred embodiment of the present invention.

Figure 1:
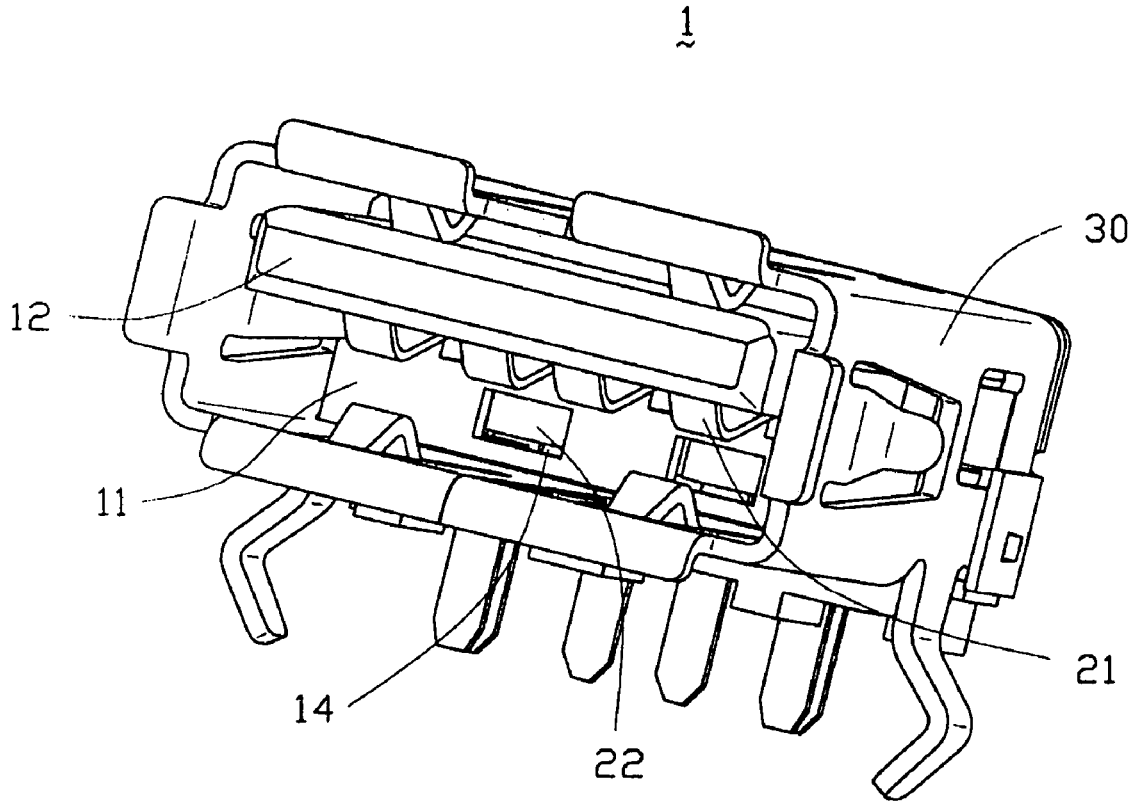
FIG. 1 is a perspective view of an electrical connector according to the present invention.
Figure 2:
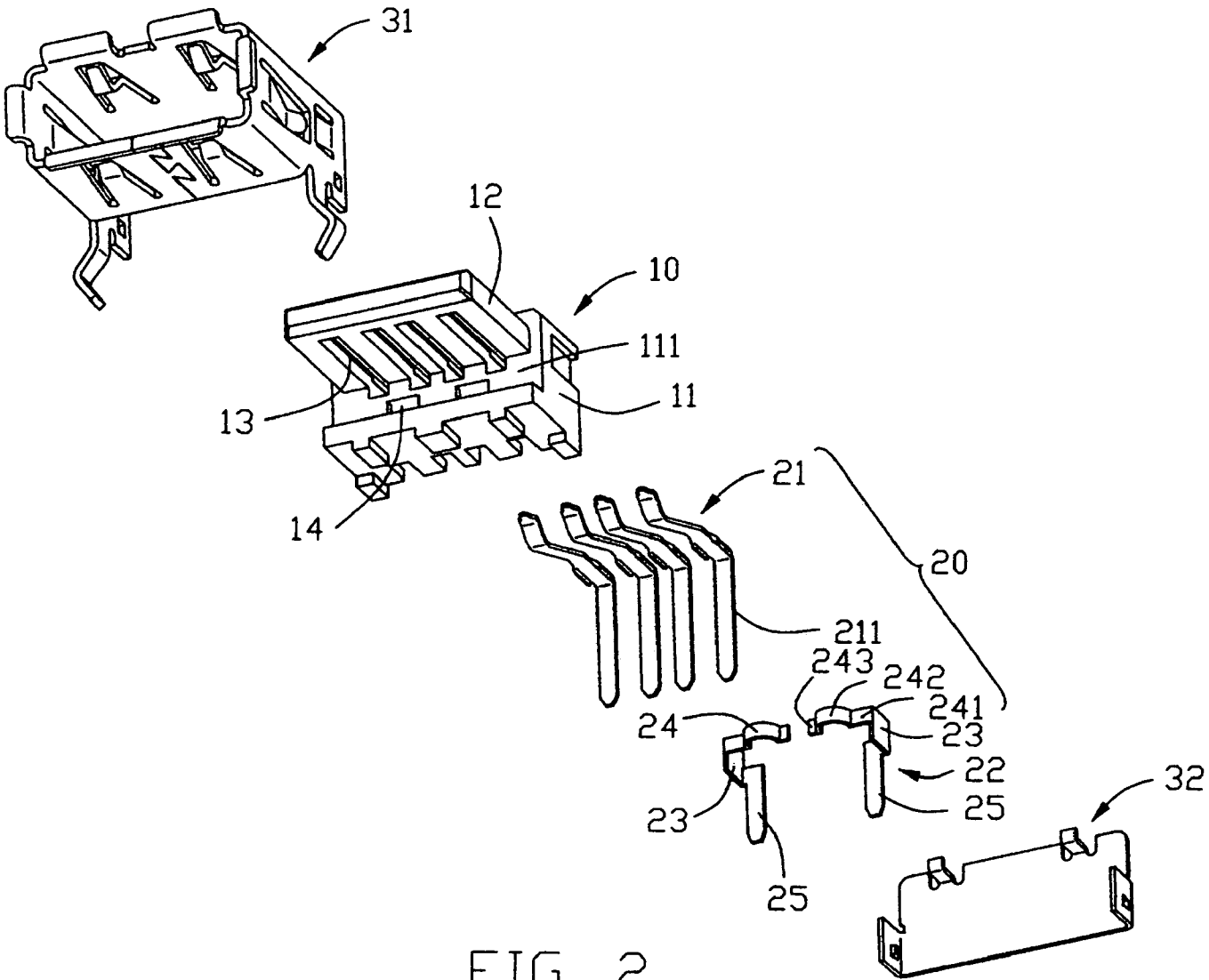
FIG. 2 is an exploded view of the electrical connector.

Referring to FIGS. 1–2, an electrical connector 1 according to the present invention includes an insulative housing 10, a plurality of conductive contacts 20 and a metal shield 30 enclosing the insulative housing 10.

Figure 3:
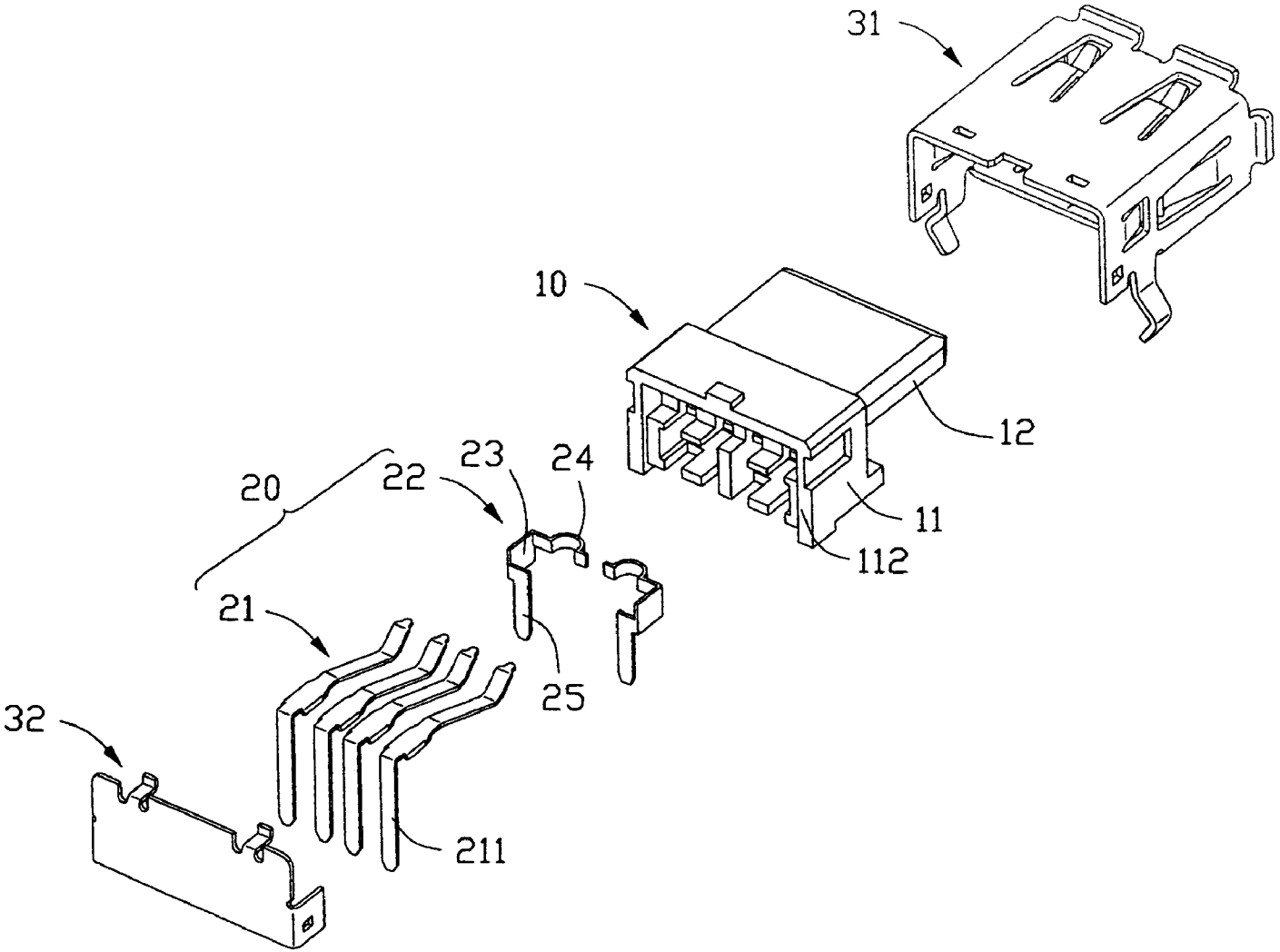
FIG. 3 is an exploded view similar to FIG. 2 but taken from another perspective.

As shown in FIGS. 2–3, the insulative housing 10 includes a base portion 11 and a tongue portion 12 forwardly extending from the base portion 11. The base portion 11 includes a mating face 111 and a mounting face 112 opposite to the mating portion 111. The tongue portion 12 defines four channels 13 longitudinally extending from a front portion to an end portion thereof in a bottom surface thereof. The base portion 12 further defines a pair of notches 14 extending from the mating face 111 to the mounting face 112 under the tongue portion 12.

Figure 4:
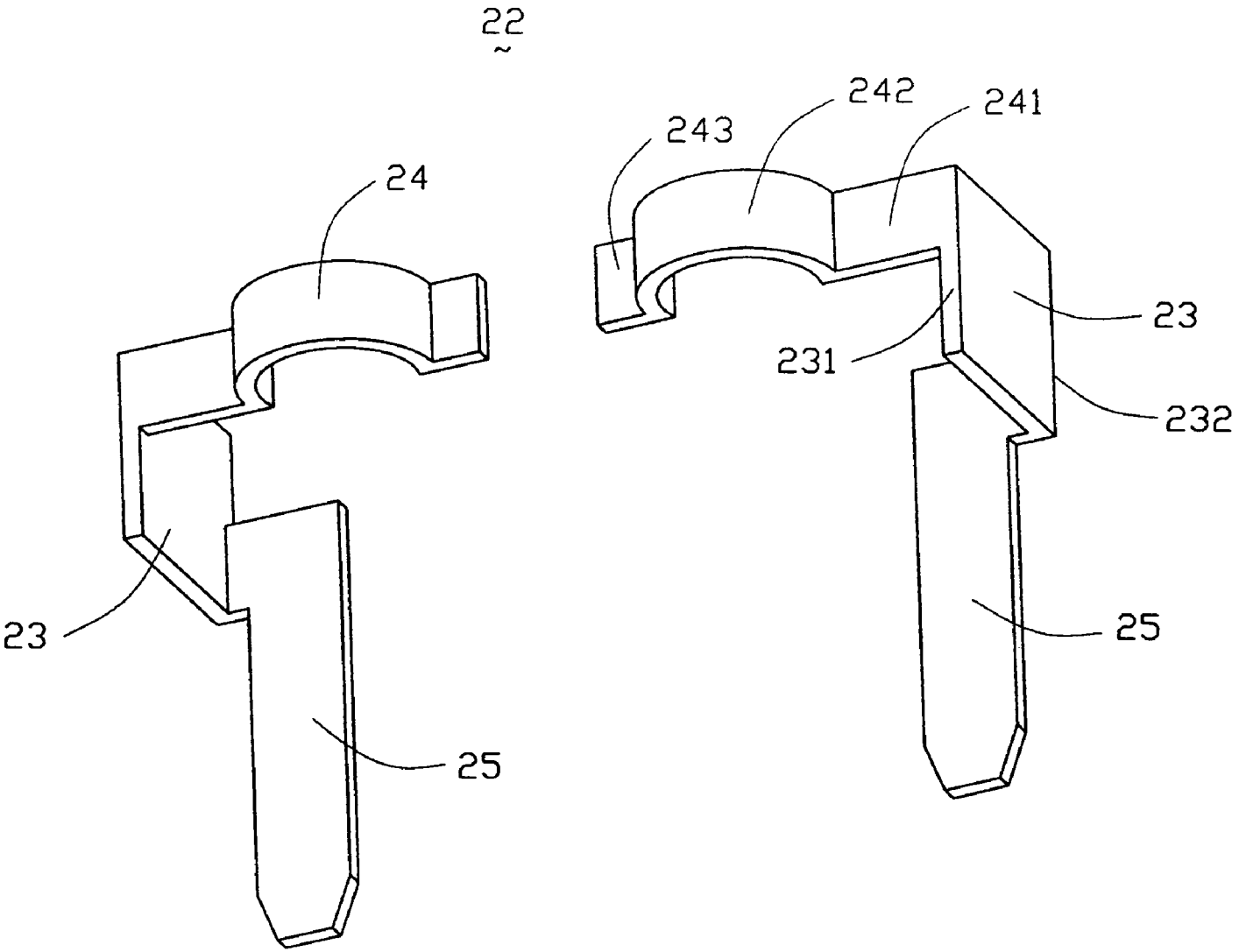
FIG. 4 is a perspective view of a pair of second conductive contacts of the electrical connector.

Referring to FIGS. 2–4, the conductive contacts 20 include four "L" shaped first conductive contacts 21 which are similar to contacts in the conventional USB connector. Therefore, the further details will not be repeated. The conductive contacts 20 further include a pair of second conductive contacts 22, shown in FIG. 4. Each second conductive contact 22 includes a rectangle shaped connecting portion 23, an "arch bridge" shaped contacting portion 24 laterally extending from an edge of the connecting portion 23 and a tail portion 25 laterally and downwardly extending from another edge of the connecting portion 23. The "arch bridge" shaped contacting portion 24 includes a beam 241 connecting with the connecting portion 23, an arch shaped portion 242 and a tail portion 243 connecting with the arch shaped portion 242. The substantially arch bridge shaped contacting portion 24 extends in a first plane and the tail portion 25 extends in a second plane. The first plane is parallel to the second plane. In addition, the connecting portion 23 extends in a direction perpendicular to the first and the second planes.

Figure 5:
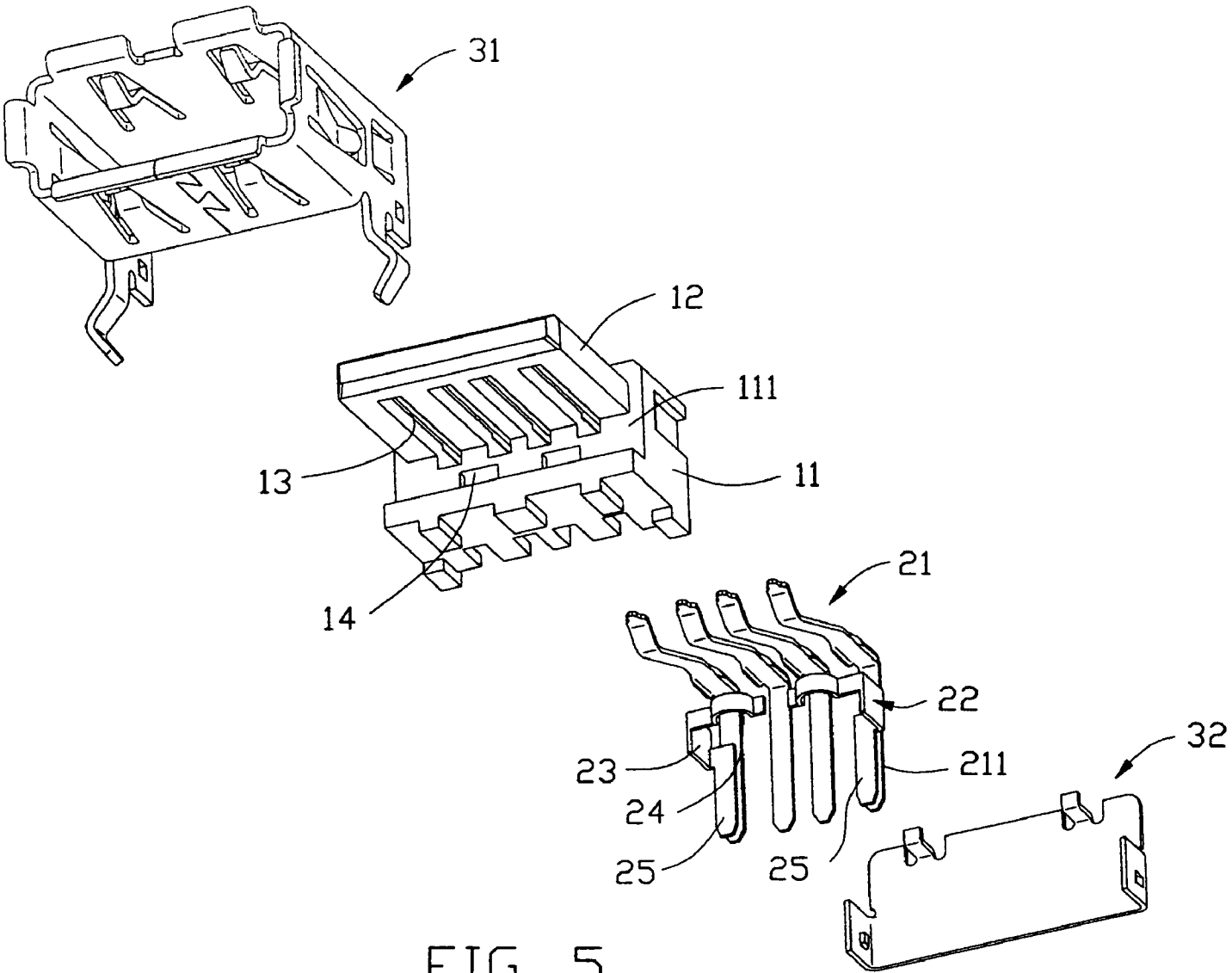
FIG. 5 is an exploded view of the electrical connector showing the position of the first contacts and the second contacts.
Figure 6:
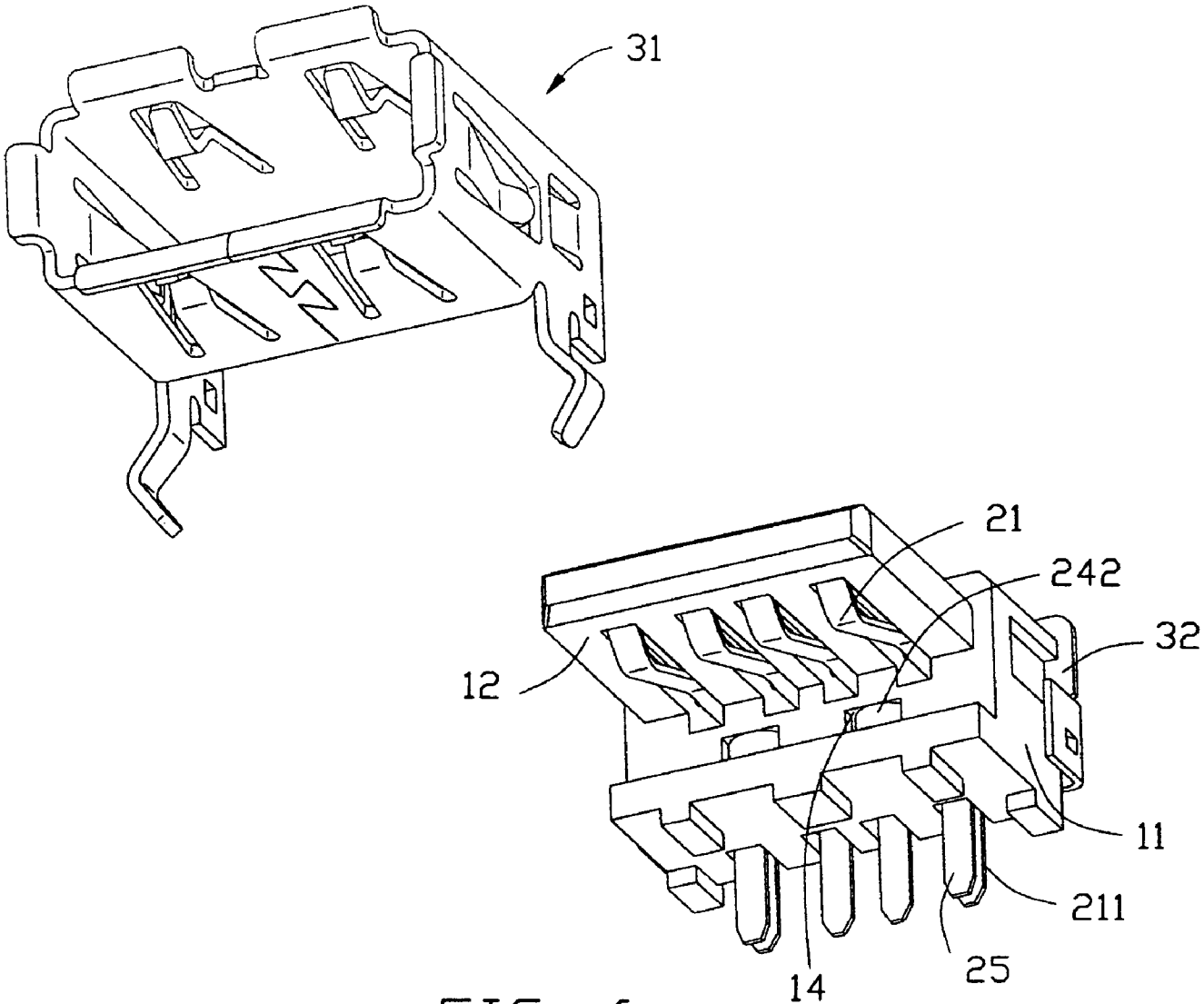
FIG. 6 is a partially exploded view of the electrical connector showing a metal shield apart from an insulative housing and the assembled first and second contacts.

Referring to FIGS. 5–6 in conjunction with FIG. 3, the four "L" shaped first conductive contacts 21 are respectively received in the channels 13 of the insulative housing 10. The tail portions of the first conductive contacts 21 downwardly extend along the mounting surface 112 of the insulative housing 10. The arch shaped portions 242 of the second conductive contacts 22 are respectively received in the corresponding notches 14 of the insulative housing 10 and beyond the mating face 111. The second conductive contacts 22 are positioned in a front portion of the outer side dual contacts of the four first conductive contacts 21. The tail portions of the second conductive contacts 22 are parallel with the tail portions of the outer side dual contacts 21.

Referring to FIGS. 5–6 in conjunction with FIG. 1, the metal shield 30 includes a receptacle 31 for shielding the insulative housing 10 and a back cover 32 for shielding the mounting face 112.

The electrical connector 1 according to the present invention includes a pair of second conductive contacts 22 which can improve the transmission speed. Furthermore, the electrical connector 1 still can mate with an existed complementary connector (not shown). Thus, the electrical connector which can realize dual functions at the same time can effectively reduce the produce cost.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing including a base with a tongue portion extending forwardly from an upper portion of said base, a receiving space formed between the tongue portion and a lower portion of said base;

a plurality of passageways disposed in the tongue portion;

a plurality of first contacts received in the corresponding passageways, respectively, with contacting portions extending downwardly beyond a bottom face of the tongue portion into the receiving space for mechanically and electrically downwardly engaging corresponding terminals to a complementary connector, and at least one second contact located at a lower portion of the base with a contacting section extending forwardly into the receiving space; wherein said at least one second contact is independent from any of said first contacts disregarding whether the complementary connector is mated with the connector or not, and said contacting section is configured to be deflectable while being efficiently engaged, without any risks of being offset, with a corresponding independent terminal of the complementary connector for independent electrical transmission.

2. The connector as claimed in claim 1, wherein the base defines one notch, and the contacting section is received in the notch with a contacting tip extending forwardly beyond the base and into the receiving space.

3. The connector as claimed in claim 1, wherein said first contacts are essentially of a Universal Serial Bus connector, and have standardized positions and pitch around the connecting portions and around tail sections thereof.

4. The connector as claimed in claim 3, wherein a tail of said at least one second contact is aligned with the tail section of one of said first contacts in a front-to-back direction.

5. The connector as claimed in claim 4, wherein the housing defines slots in a rear portion of the base for aligning the corresponding tail sections of the first contacts, and one of said slots receives said the tail of said at least one second contact.

6. The connector as claimed in claim 5, wherein the contacting section of the at least one second contact is essentially located between two corresponding contacting portions of the two adjacent first contacts.

7. The connector as claimed in claim 3, wherein the tail of the at least one second contact is located in front of the tail section of the corresponding first contact.

8. An electrical connector comprising:

an insulative housing including a base with a tongue portion extending forwardly from an upper portion of said base, a receiving space formed between the tongue and a lower portion of said base;

a plurality of passageways disposed in the tongue portion;

a plurality of first contacts received in the corresponding passageways, respectively, with contacting portions extending downwardly beyond a bottom face of the tongue portion into the receiving space for mechanically and electrically downwardly engaging corresponding terminals to a complementary connector; and at least one second contact located at a lower portion of the base with a contacting section extending forwardly through a notch of the base and into the receiving space; wherein said housing defines structures to allow both the first contacts and said at least one second contact to be assembled to the housing in a forward direction from a rear portion of the base without interference.

9. The connector as claimed in claim 8, wherein first contacts are essentially of a standard Universe Serial Bus connector while the at least one second contact does not intervene therewith.

10. The connector as claimed in claim 8, wherein the contacting section of the at least one second contact is not aligned with that of any of the first contacts in a front-to-back direction.

11. The connector as claimed in claim 8, wherein a tail of said at least one second contact is aligned with a tail section of one of the first contacts in a front-to-back direction.

12. The connector as claimed in claim 11, wherein the base defines a slot receiving both said tail of the at least one second contact and said tail section of said one of the first contacts.

* * * * *